US006398484B1

(12) United States Patent
Orikasa et al.

(10) Patent No.: US 6,398,484 B1
(45) Date of Patent: Jun. 4, 2002

(54) CENTRIFUGAL COMPRESSOR AND SHAFT SEAL

(75) Inventors: Hideaki Orikasa, Chiyoda; Hideto Nogiwa, Tsukuba, both of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/508,470

(22) PCT Filed: Mar. 13, 1998

(86) PCT No.: PCT/JP98/01067

§ 371 (c)(1),
(2), (4) Date: Mar. 10, 2000

(87) PCT Pub. No.: WO99/46512

PCT Pub. Date: Sep. 16, 1999

(51) Int. Cl.[7] ..... F04D 29/04; F04D 29/12

(52) U.S. Cl. ..... 415/112; 415/111; 415/176; 415/177; 415/180; 415/230; 415/24

(58) Field of Search ..... 415/111, 112, 415/175, 176, 177, 180, 230, 24; 277/408, 411, 422, 907, 930

(56) References Cited

U.S. PATENT DOCUMENTS 3,020,053 A * 2/1962 Millar et al. ..... 277/422
4,477,223 A * 10/1984 Giroux ..... 415/111

FOREIGN PATENT DOCUMENTS

| | | |
|---|---|---|
| JP | 53-99468 | 1/1978 |
| JP | 55-39891 | 9/1980 |
| JP | 58-193997 | 11/1983 |
| JP | 61-237899 | 10/1986 |
| JP | 2-15085 | 4/1990 |
| JP | 4-60193 | 2/1992 |
| JP | 4-73664 | 6/1992 |
| JP | 8-121109 | 5/1996 |
| JP | 9-53593 | 2/1997 |

OTHER PUBLICATIONS

Copy of International Search Report dated Jun. 23, 1998. Document No. E5069—Information Under 37 CFR 1.56(a).

* cited by examiner

*Primary Examiner*—Christopher Verdier
(74) *Attorney, Agent, or Firm*—Crowell & Moring LLP

(57) ABSTRACT

A shaft seal system prevents working gas in a centrifugal compressor from leaking outside from the compressor. The shaft seal system is of an oil film seal type and located in the compressor in which a plurality of centrifugal impellers are fitted on a single rotary shaft and are adapted to be rotated at a high speed. The system has two kinds of seal rings, that is, an atmospheric side seal ring and a gas side seal ring, which are loosely fitted in a casing in which bearing for rotatably journalling the rotary shaft are incorporated. A sealing sleeve shrinkage-fitted on the rotary shaft is arranged on the inner diameter side of the two kinds of seal rings. The rotary shaft is formed in its center axial part thereof with a bore extending from a suction side end to a position where the oil film seal is arranged, and a plurality of oil feed holes extending through the rotary shaft from the bore to the outer periphery of the rotary shaft. Seal oil is fed from the suction side of the rotary shaft into clearances between the two kinds of seal rings and the sealing sleeve so as to prevent working gas compressed in the centrifugal compressor from leaking outside from the compressor, and to cool the shaft seal which has been heated up to a high temperature by friction heat with the seal oil.

11 Claims, 3 Drawing Sheets

CENTRIFUGAL COMPRESSOR AND SHAFT SEAL

FIELD OF THE INVENTION

The present invention relates to a centrifugal compressor having an oil film seal system and a shaft seal therefor, and in particular, relates to a multi-stage centrifugal compressor having an oil film seal system and a shaft seal system therefor.

RELATED ART

Heretofore, there has been widely used so-called oil film seals each having a seal ring fitted on a rotary shaft with a clearance therebetween, and oil is fed to the outer peripheral surface of the sealing ring through an oil feed passage formed in the casing side in order to seal working gas and bearing lubrication oil in a centrifugal compressor. For example, Japanese Laid-Open Patent No. 08-121109 discloses a device using an oil film seal, as mentioned above.

The oil film seal has the following features:

(a) an oil film formed in the oil film seal system can completely seal working gas in a centrifugal compressor so as to prevent it from leaking from the compressor.

(b) This oil film seal is a noncontact type seal so that no sliding parts including a mechanical seal or a lip seal are incorporated, and accordingly, friction and abrasion are less so that the long term continuous operation can be made. Further, due to the noncontact type, it can be used even though the peripheral speed of the rotary shaft of a seal part is high (about 80 m/s), and accordingly, it can be used in a high power machine.

(c) By changing the pressure of oil to be fed, the working gas in the compressor can be sealed so as to be prevented from leaking into the outside of the compressor even though the pressure of the gas is high.

(d) The oil film seal can remove heat generated in the seal part through the seal oil, and accordingly, the seal has highly safe and reliable.

The oil film seal forms an oil film having a pressure which is slightly higher than a pressure of the working gas in the compressor, between the sealing ring and the shaft, so as to seal the gas. Further, a single oil film seal system has two seal rings one of which is located on the inside side (gas side) of a centrifugal compressor and the other one of which is located on the outside (atmospheric side) of the compressor. These seal rings are incorporated in a seal housing formed in a casing so as to define extremely narrow clearances between themselves and a rotary shaft and to follow fine motion of the rotary shaft. Oil having a pressure which is slightly higher than the gas in the compressor is fed into a space between two seal rings, one of which is on the inside of the compressor and the other is on the outside of the compressor. Some of the fed oil flows toward the atmospheric side seal ring while the remainder thereof flows into the compressor side through the annular clearance between the seal ring on the inside of the compressor and the shaft by a slight amount. Thus, it is possible to prevent the working gas in the compressor from flowing into the atmospheric side.

In this conventional oil film seal system, oil discharged from the gas side is made into contact with gas in the compressor. Accordingly, the seal oil is excessively contaminated by the gas in the compressor if the gas is of a certain kind. Discharged oil which is possibly contaminated by a large degree, is led into a drain trap where the gas is separated from the oil, and then, the oil is retrieved or exhausted. In order to minimize the quantity of the exhausted oil which is so-called "sour drain", the following methods have been conventionally used:

1) The differential pressure between the supplied oil and the gas inside of compressor to be fed is lowered; and 2) The clearance between the gas side seal ring and the rotary shaft is reduced.

If the differential pressure in the compressor is extremely small as stated in item 1, the gas is likely to leak into the outside from the compressor, and meanwhile, if the clearance is extremely small as stated in item 2, the temperature at the inner surface of the gas side seal ring is raised excessively, resulting in that the seal ring is damaged by burning, or the possibility of a risk of making the seal ring into contact with the rotary shaft is increased. Indeed, there have been reported many accidents such that the gas side seal ring is damaged by burning. In particular, should any trouble occur in a centrifugal compressor as one of important components of any of various plants including a petroleum refining plant and a chemical plant, such a plant would be inoperative throughout the system. Thus, it is very important to ensure the reliability for the shaft seal system including the oil film seal system.

Further, the seal ring is fitted on the rotary shaft with a clearance defined therebetween, and the so-called sealing sleeve is normally shrinkage-fitted on the rotary shaft in a part facing the outer seal ring in order to protect the rotary shaft surface. Since seal oil is fed at the outer peripheral side in the oil film seal, this seal ring is heated by the seal oil so as to expand, and accordingly, unbalance load would possibly be applied to the rotary shaft. As a result, there would have been such a disadvantage that the rotor including the rotary shaft incurs unbalance vibration.

DISCLOSURE OF THE INVENTION

The present invention is devised in view of the above-mentioned problems and disadvantages inherent to the prior art, and one object of the present invention is to provide an oil film seal used in a centrifugal compressor with an enhanced reliability. Further, in particular, an object of the present invention is to provide an oil film seal system which can prevent a gas side seal ring from being damaged by burning and consequently enhance the reliability.

Another object of the present invention is to provide a centrifugal compressor incorporating an oil film seal system which can reduce unbalance vibration of a rotor caused by unbalance of a seal part.

The other object of the present invention is to provide a centrifugal compressor incorporating an oil film seal system which can achieve the above-mentioned objects with only a simple structure.

To the end according to the first aspect of the present invention, there is provided a centrifugal compressor comprising a rotary shaft, a casing attached thereto with bearing means for rotatably journalling the rotary shaft, at least one centrifugal impeller fitted to the rotary shaft, a shaft seal system for preventing gas compressed by the centrifugal impeller from leaking through a gap between said rotary shaft and the casing, the shaft seal system comprising a gas side seal ring arranged axially outside of the impeller with a radial clearance between itself and the casing, and an atmospheric side seal ring located outside from the gas side seal ring with a radial clearance between the casing, and an oil feed passage for supplying oil to both seal rings is formed in the rotary shaft.

Preferably, the bearing means are provided at two positions in the axial direction, and two shaft seal systems are provided inward from the bearing means in the axial direction of the compressor, or alternatively, the oil passage formed in the rotary shaft has an opening at one end of the rotary shaft, an oil feed bore passing through the center axial part of the rotary shaft, a plurality of oil feed holes communicated with the oil feed bore and formed in the rotary shaft so as to be extended radially outward, the plurality of feed holes being located at an axial position which is in an axially intermediate part of the gas side seal ring, the rotary shaft is incorporated thereon with sealing sleeves for covering the rotary shaft, corresponding to positions where the gas side seal ring and the atmospheric side seal ring are provided respectively, the rotary shaft is provided with a chamber for reserving oil fed from the oil feed bore, at the one end side where the oil feed bore is opened, and mechanical seal means for sealing between the rotary shaft and the casing is provided axially inward from the chamber.

In order to achieve the above-mentioned objects, according to a second aspect of the present invention, there is provided a centrifugal compressor having oil film seal systems provided at two positions in the axial direction of the rotary shaft, a first bore is formed in the center axial part of the rotary shaft, and second holes are formed in the rotary shaft at positions where the oil seal systems are attached, being communicated with the first bore and opened at the outer periphery of the rotary shaft.

Preferably, there are provided a head tank for reserving oil adapted to be fed into the oil seal systems, and a control means for controlling the level of the oil in the head tank. Alternatively, the oil film seal system has a gas side seal ring and an atmospheric side seal ring, a degassing means for cooling the gas side seal ring so as to remove working gas components from oil mixed therewith, and a reservoir for mixing oil with which the atmospheric side seal ring has been cooled, and the oil from which the working gas is removed by the degassing means, with each other.

In order to achieve the above-mentioned objects, according a third aspect of the present invention, there is provided an shaft seal system for a centrifugal compressor, comprising a gas side seal ring and an atmospheric side seal ring which are loosely fitted in a housing, and sealing sleeves located on the inner diameter sides of these seal rings, and each having a plurality of holes radially extending through the sleeves.

Preferably, there are provided a head tank for reserving oil adapted to be fed to both seal rings through he plurality of holes at the inner diameter side, and a control means for controlling the level of the oil in the head tank.

BEAT MODE FOR CARRYING OUT THE INVENTION

Explanation will be made of several embodiments of the present invention with reference to the drawings.

Figure 1:
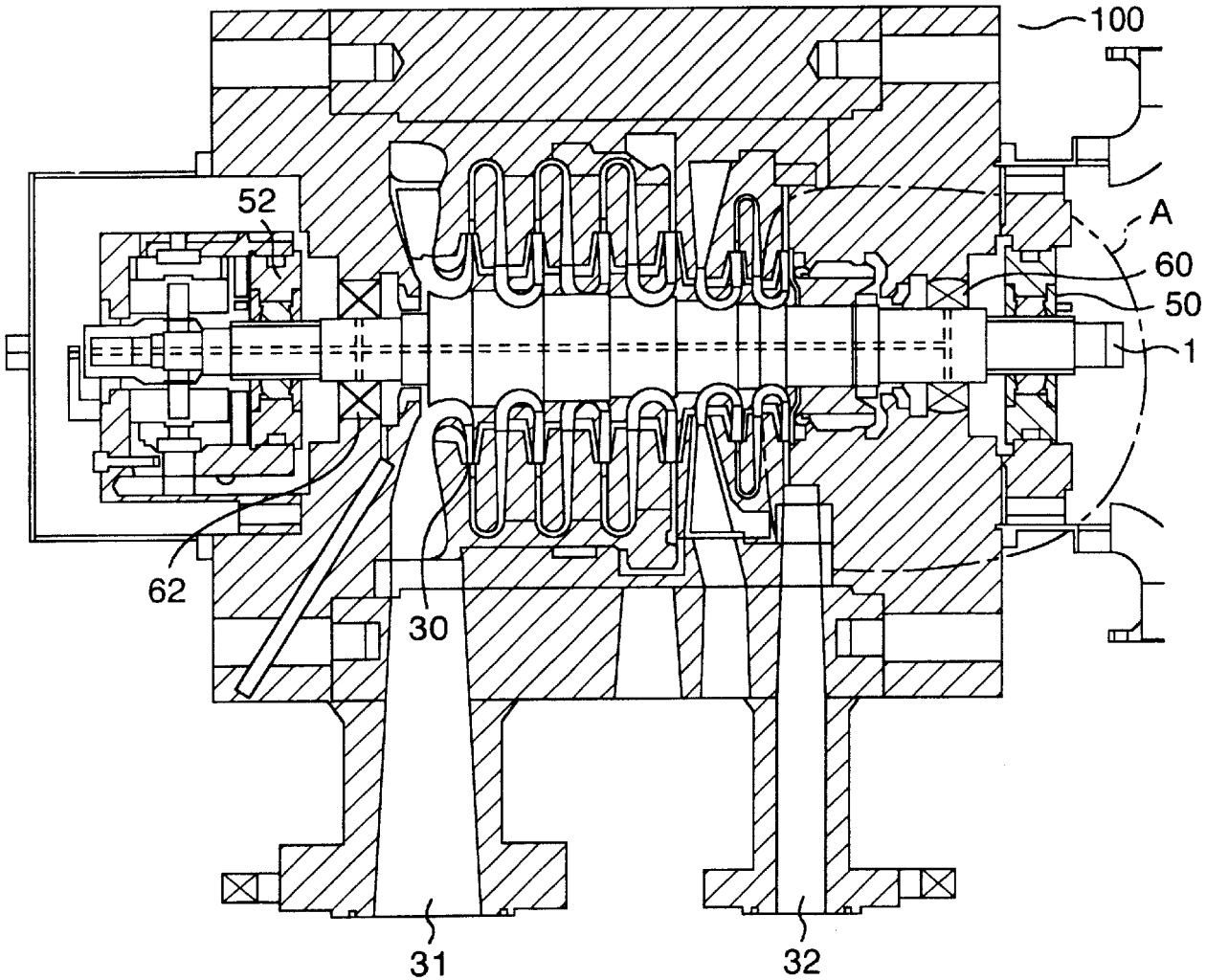
FIG. 1 is a longitudinal sectional view illustrating a multistage centrifugal compressor according to the present invention.
Figure 2:
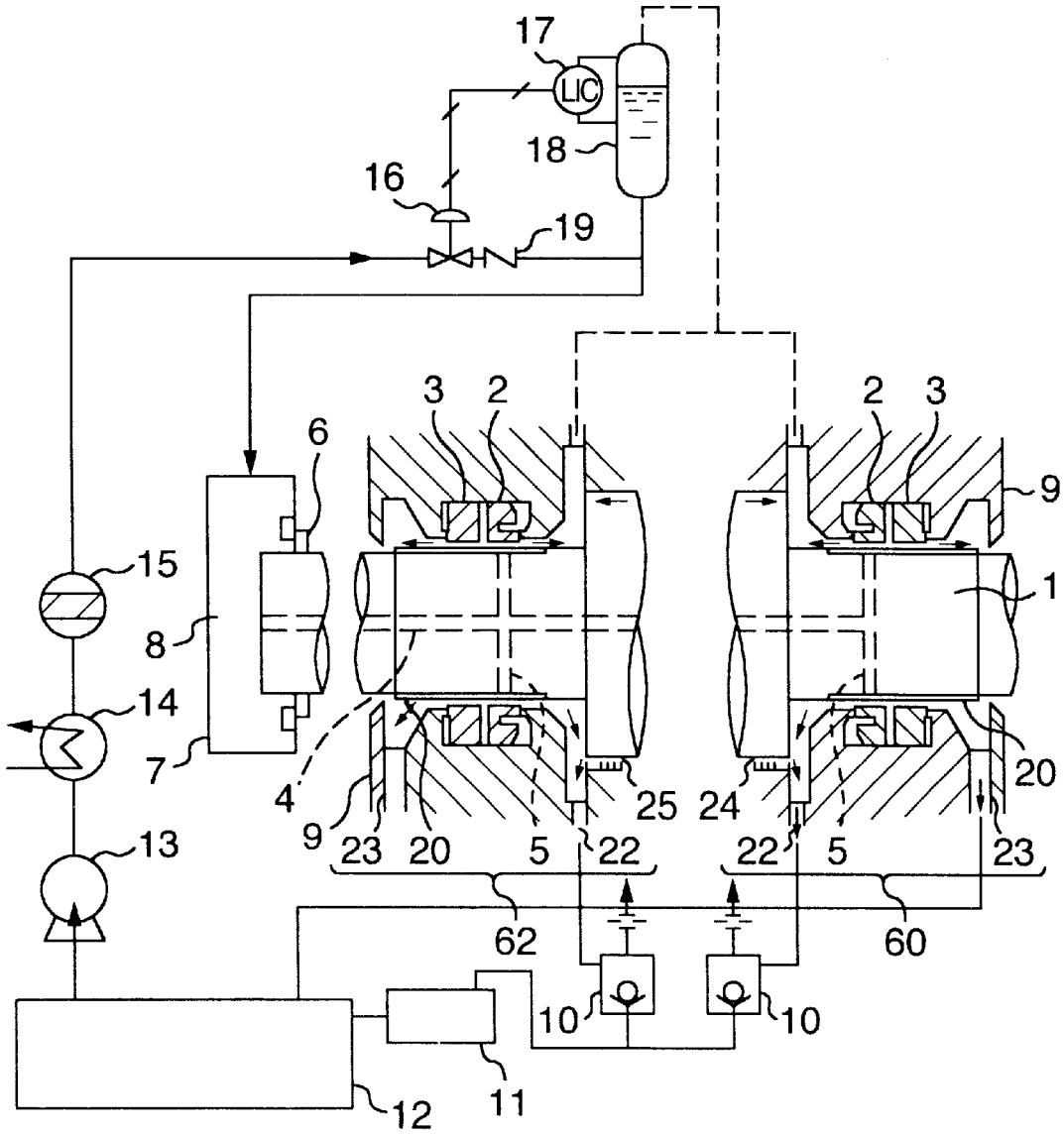
FIG. 2 is a view for illustrating an embodiment of the centrifugal compressor according to the present invention, in which an oil feed system and a seal part are shown in detail in a longitudinal section.

FIG. 1 is a longitudinal sectional view illustrating a multi-stage centrifugal compressor according to the present invention, and FIG. 2 is a view which shows a first embodiment of the present invention, and in which an oil feed system and an oil film seal part in the multistage centrifugal compressor is shown in detail in a section.

A single shaft multistage compressor 100 including a plurality of centrifugal impellers 30 fitted on a single rotary shaft 1 which is journalled by bearing devices 50, 52 provided in opposite end parts of the rotary shaft 1, and adapted to be driven at a high speed by a prime-mover which is not shown, is used in a chemical plant or the like, and can treat various kinds of gases such as combustible gas and toxic gas. In this single-shaft multistage compressor, working gas sucked through a suction port 31 is compressed as the rotary shaft 1 is rotated, so as to have a desired pressure before it is fed into a source of demand. This single-shaft multistage compressor 100 is a high capacity device, and further, requires seals for preventing the working gas from leaking from the compressor 100 since the working gas discharged from a discharge port 32 is high. As to the high pressure seals, an oil film seal as discussed mentioned above, is preferable, and accordingly, in general, oil film seal systems are provided inside of the bearing seal systems 50, 52. In this arrangement, the oil film seal systems 60, 62 are connected with each other by a balance pipe line which is not shown, so as to set the pressure of the atmospheric gas of both oil film seal systems 60, 62 to a value which is substantially equal to the suction pressure of the working gas. It is noted that one and the same kind of oil is fed to the bearing devices 50, 52 and the shaft seal systems 60, 62.

FIG. 2 shows, in detail, a part A of the single-shaft multistage compressor illustrated in FIG. 1, in which an oil feed system and the seal systems 60, 62 are provided. Seal oil 8 adapted to be fed into the seal systems 60, 62 is reserved in an oil reservoir 12 which is separately provided to the body of the single-shaft multistage compressor 100. The seal oil 18 reserved in the oil reservoir 12 is pressurized by an oil pump 13, and thereafter, is cooled by an oil cooler 14. Then, the seal oil 18 is passed through an oil filter 15 for removing foreign matter in order to be circulated being used as fresh lubrication oil and seal oil. The oil from which impurities are removed, and is adjusted to a pressure required for the oil film seal systems 60, 62 before it is fed into a chamber 7 provided in an end part of the rotary shaft 1 on the suction side.

It is noted here that a height of the liquid surface of the oil in a head tank 18 is detected by a level gage from which delivers a detected value to a controller 17 in order to adjust the pressure of the oil. The controller 17 adjusts the opening degree of a control valve 16 in order to maintain the height of the liquid surface of the oil in the head tank 18 at a constant value. The height of the liquid surface of the oil is adjusted so as to set the pressure differential between the pressure of the seal oil and the suction pressure of the working gas to about a 0.5 $kg/cm^2$. Since the height of the liquid surface of the oil in the head tank 18 is maintained to be constant, a constant differential pressure can be always applied to the two seal rings 2, 3 loosely fitted in the housing 9 even though the pressure in the single-shaft multistage compressor 100 varies, and accordingly, it is possible to obtain a stable predetermined sealing function. A check valve 19 which is provided between the control valve 16 and the head tank 18, can prevent the seal oil 8 reserved in the head tank 18 from counter-flowing toward the reservoir 12 so as to cause a shortage of oil in the oil film seal systems 60, 62.

The seal oil 8 fed into the chamber 7 provided at the one end part of the rotary shaft 1, is led through an oil feed bore 4 deeply formed in the center axial part of the rotary shaft 1 so as to extend in the axial direction of the rotary shaft 1 up to the discharge side seal system 60, and oil feed holes 5 communicated with the oil feed bore 4 and radially formed in the rotary shaft 1, and is then fed into the gas side seal ring 2 by way of holes formed in a sealing sleeves 20 shrink-fitted on the rotary shaft 1. In this arrangement, a mechanical seal 6 is provided on the rotary shaft 1 in the vicinity of an axial end thereof in order to prevent the seal oil from leaking from the compressor in the vicinity of the oil feed bore 4. By the way, a part of the compressed gas in the centrifugal compressor leaks into the seal devices 60, 62 by way of labyrinths 24, 25, but is mixed with the seal oil 8 which has cooled the gas side seal ring 2, and is then led through an oil discharge hole 22 and into a drain pot 10 provided outside of the compressor. Thereby it is possible to prevent leakage of the working gas.

Meanwhile, the remainder of the seal oil 8 fed into the oil film seal systems 60, 62 absorbs heat from the gas side seal ring 2 and those therearound so as to raise its temperature up to a high valve. Then, it flows through the clearance between the atmospheric side seal ring 3 and the shaft 1, and flows into an oil discharge hole 23 formed at an axial end of the shaft before it returns into an oil reservoir 12. The discharged oil which is a mixture of working gas once reserved in a drain port 10, and the seal oil 8, is led into a degassing tank 11. Working gas components are removed from the mixture of the working gas and the seal oil 8 in the degassing tank 11, and accordingly, only the seal oil 8 is returned into the oil reservoir 12 and is then reused or exhausted. The working gas removed from the mixture in the degassing tank 11 is properly treated if it is detrimental or burnable in order to prevent occurrence of pollution problems and accidents.

It is noted that the seal oil 8 is fed through the oil feed bore 4 and the holes 5 which are formed in the shaft, and accordingly, the oil 8 can be fed into the center part of the gas side seal ring 2. Accordingly, the axial length of the gas side seal ring 2 can be longer than that of the conventional one. Further, since the gas side seal ring 2 can be uniformly cooled substantially in its entirety, and accordingly, the effect of heat radiation can become higher. Moreover, since the temperature gradient of the seal ring part can be reduced, the clearance between the seal ring 2 and the rotary shaft 1 can be maintained at a substantially appropriate value. Accordingly, with the arrangement of this embodiment, it is possible to prevent occurrence of a problem of damage of the atmospheric seal ring by burning, which has often occurred conventionally.

Further, in the above-mentioned embodiment in which the seal oil 8 is fed from the inside of the rotary shaft 1, the rotary shaft 1 and the sealing sleeve 20 can be cooled down to one and the same temperature, substantially. Conventionally, the seal oil has been fed from the outer periphery of the rotary shaft, and as a result, the seal sleeve 20 having a thickness of about 3 mm, is heated up to a high temperature so as to thermally expand at first by the temperature of the working gas and frictional heat, but the rotary shaft having a diameter of about 100 mm does not greatly raise its temperature. Thus, the shrinkage fitting therebetween would possibly loosened, and accordingly, the sealing sleeve moves freely so as to cause unbalance vibration of the rotary shaft. On the contrary, according to the present invention having the above-mentioned arrangement, it is possible to radically prevent occurrence of this unbalance vibration.

Figure 3:
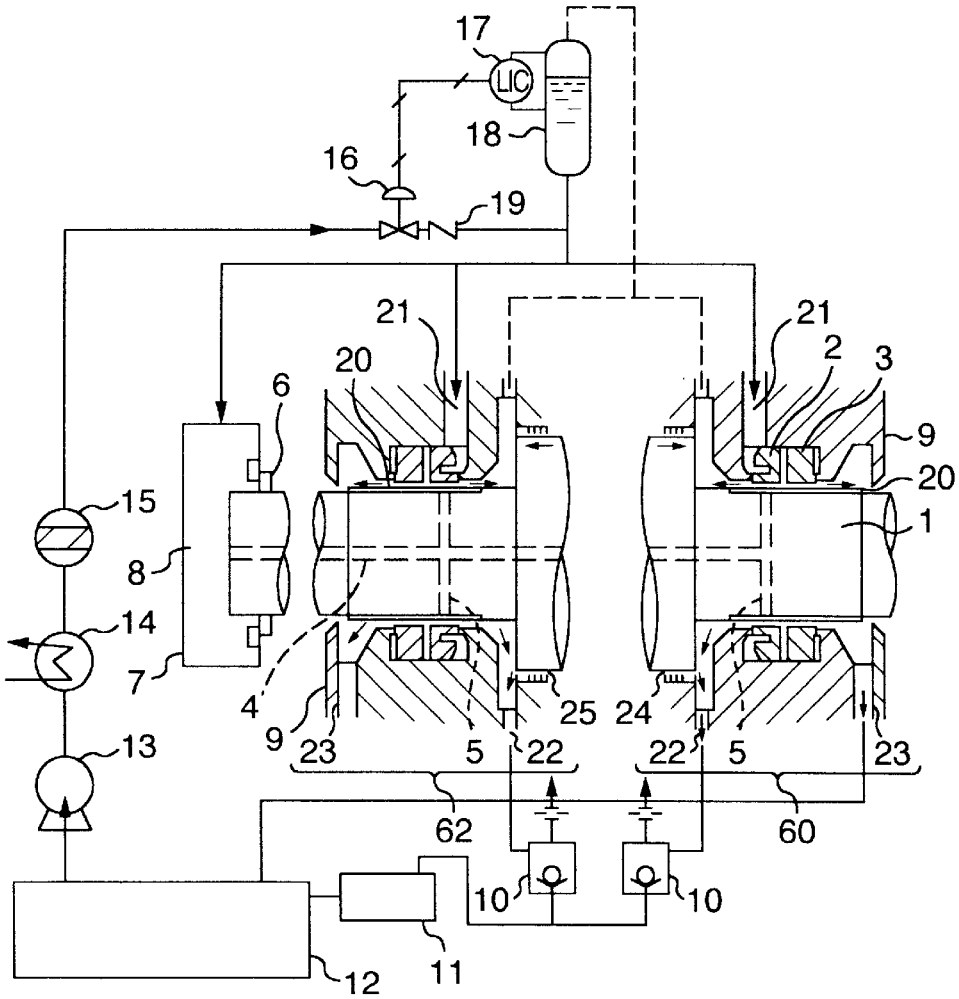
FIG. 3 is another embodiment of the centrifugal compressor according to the present invention, in which an oil feed system and a seal part are shown in detail in a longitudinal section.

Next, another embodiment of the present invention is shown in FIG. 3. In FIG. 3, the oil feed from the outer periphery of the rotary shaft, which has been conventionally used, and the oil feed explained in the above-mentioned embodiment are used together. The oil film seal systems in this embodiment, oil seal feed passages for feeding the seal oil 8 pressurized by the oil pump 13 to the seal rings 2, 3 are additionally formed. In this arrangement, the sealing and the cooling can be surely made in comparison with the above-mentioned embodiment. Further, the seal oil is fed from the inside of the rotary shaft, similar to the above-mentioned embodiment shown in FIG. 2, it is possible to prevent occurrence of vibration of the rotor caused by thermal expansion only of the gas side seal ring 2 and the sealing sleeve 20.

Figure 4:
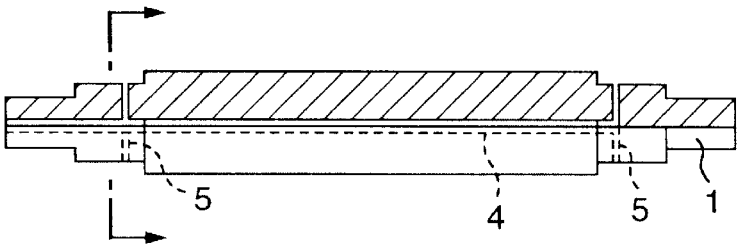
FIG. 4 is a partly sectioned view illustrating a rotary shaft in the centrifugal compressor according to the present invention in detail.

FIG. 4 shows the rotary shaft 1 used in the above-mentioned two embodiments, in detail. In order to feed the oil from the inside of the rotary shaft 1 into the oil film seal parts, the oil feed bore 4 is formed along the center axis of the axial center part of the rotary shaft 1. Further, in order to feed the oil to the seal rings, the radial oil feed holes 5 are formed in the rotary shaft 1 at a plurality of axial positions corresponding to the seal rings. As shown in a sectional view along line B-B in FIG. 4, these oil feed holes 5 are radially formed in the rotary shaft 1 so as to extend in the radial direction of the shaft from the center axis thereof, being angularly spaced at equal pitches. It is noted that the seal oil 8 fed through these radial holes 5 cools both the rotary shaft 1 and the sealing sleeves 20, simultaneously, and accordingly, the temperatures of the rotary shaft and the sealing rings 20 can be substantially maintained at one and the same value, as mentioned above.

As mentioned above, according to the present invention, the seal ring can be prevented from being damaged by burning, due to the provision of the oil film seal, and the rotor can be prevented from being vibrated by being caused by thermal expansion of the sealing sleeves. Thereby it is possible to greatly enhance the reliability, the safety, the stability of a centrifugal compressor and as well the reliability and the safety of the entire plant.

It is noted that although one and the same kind of oil is used as both lubrication oil for the bearing parts and seal oil fed into the oil film seal parts in the above-mentioned embodiment, different kinds of oil may be used as the lubrication oil and the seal oil, respectively. In this case, there may be exhibited such an advantage that optimum kinds of oil can be used for their purposes, respectively. Further, although the seal oil is fed at the suction side end face of the rotary shaft, it goes without saying that the oil can be fed at the discharge side end face or both end faces of the rotary shaft. Further, the oil feed bore may be extended throughout the rotary shaft. Further, although only one axial position where the radial oil feed holes are formed in the rotary shaft is set for each of the seal film seals, a plurality of positions may be set therefor. Further, it has been stated that the oil film seals are provided in the single-shaft multistage centrifugal compressor in the above-mentioned embodiment, the present invention may be applied in another type of compressors such as a single stage compressor or a multishaft type compressor.

That is, the present invention can be practiced in other various modes without departing the main sprits, concepts and features of the present invention. Thus, it should be noted that the embodiments stated in the specification are of mere exemplified forms to which the present invention should not be limited. The scope of the present invention should be defined by the appended claims, and accordingly, all variant forms of the above-mentioned embodiments should be considered to be fallen within the scopes of the present invention.

What is claimed is:

1. A centrifugal compressor comprising:

a rotary shaft;

a casing attached thereto with bearing means for rotatably journalling the rotary shaft;

at least one centrifugal impeller attached to the rotary shaft; and a shaft seal system for preventing gas compressed by said impeller from leaking through a clearance between said casing and said rotary shaft; wherein said shaft seal system is composed of a gas side seal ring which is arranged axially outward from said at least one impeller with a radial clearance with respect to said casing, and an atmospheric side seal ring arranged outward from said gas side seal ring with a radial clearance with respect to the casing, and said rotary shaft is formed therein with an oil passage for feeding oil to said two seal rings.

2. A centrifugal compressor as set forth in claim 1, wherein said bearing means is provided at each of two axial positions, and shaft seal means is provided at each of two positions axially inward from said bearing means.

3. A centrifugal compressor as set forth in claim 2, wherein said oil feed passage formed in said rotary shaft includes an oil feed bore having an opening at one end of said rotary shaft and extending through a center axis part of the rotary shaft, and a plurality of radial oil feed holes communicated with said oil feed bore and extending radially outward.

4. A centrifugal compressor as set forth in claim 3, wherein the axial position of said oil feed holes is set in an axially intermediate part of said gas side seal ring with which said oil feed holes are associated.

5. A centrifugal compressor as set forth in claim 1, wherein sealing sleeves for covering the rotary shaft are provided corresponding to positions where the gas side seal ring and the atmospheric side ring are located.

6. A centrifugal compressor as set forth in claim 3, wherein a chamber for accommodating the oil fed through the oil feed hole is provided at the opening end of the oil feed bore in the rotary shaft.

7. A centrifugal compressor comprising two oil film seal systems provided at two positions in an axial direction of a rotary shaft, wherein an axial bore is formed centrally of said rotary shaft, and a plurality of holes operatively communicates with said axial bore and opens at an outer periphery of said rotary shaft, the axial bore and the holes operatively communicating at positions where said oil film seal systems are provided.

8. A centrifugal compressor as set forth in claim 7, further comprising a head tank for reserving oil adapted to be fed to said oil film seal systems, and control means for controlling the level of the oil in the head tank.

9. A centrifugal compressor as set forth in claim 8, wherein each of said oil film seal systems comprises a gas side seal ring and an atmospheric side seal ring, a degassing means for cooling said gas side seal ring so as to remove gas components from the oil with which working gas is mixed, and an oil reservoir for mixing the oil having cooled said atmospheric side seal ring with the oil having been degassed by the degassing means.

10. A shaft seal system used in a centrifugal compressor having a rotary shaft formed therein with an oil feed passage, wherein said shaft seal system comprises a gas side seal ring and an atmospheric seal ring, which are loosely fitted in a housing, and sealing sleeves arranged on an inner diameter side of said seal rings, fixed to the rotary shaft, and having a plurality of holes formed in and radially extending through the sealing sleeves, whereby oil is fed to the gas side seal ring through the oil feed passage formed in the rotary shaft and the holes formed in the sleeves.

11. A shaft seal system used in a centrifugal compressor as set forth in claim 10, further comprising a head tank for reserving oil adapted to be fed to both said seal rings through said plurality of holes from the inner diameter side of the seal rings, and control means for controlling the level of the oil in the head tank.

* * * * *

UNITED STATES PATENT AND TRADEMARK OFFICE

CERTIFICATE OF CORRECTION

PATENT NO. : 6,398,484 B1
DATED : June 4, 2002
INVENTOR(S) : Hideaki Orikasa et al.

Figure 4A:
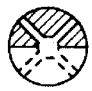

It is certified that error appears in the above-identified patent and that said Letters Patent is hereby corrected as shown below:

Column 3,
Line 67, change the period to -- ; and --
Line 68, add, -- Fig. 4A is a cross-sectional view in the plane of the dashed lines in Fig. 4 and in the direction of the arrows in Fig. 4. --

Signed and Sealed this

Twelfth Day of November, 2002

*Attest:*

*Attesting Officer*

JAMES E. ROGAN
*Director of the United States Patent and Trademark Office*